US008856989B2

(12) United States Patent
Lambarth et al.

(10) Patent No.: US 8,856,989 B2
(45) **Date of Patent: *Oct. 14, 2014**

(54) EMERGENCY STRETCHER

(75) Inventors: Cliff Lambarth, Portage, MI (US); Steve Knipfel, Portage, MI (US); Jason Kneen, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 944 days.

This patent is subject to a terminal disclaimer.

(21) Appl. No.: 12/350,579

(22) Filed: Jan. 8, 2009

(65) Prior Publication Data

US 2009/0178200 A1 Jul. 16, 2009

Related U.S. Application Data

(60) Provisional application No. 61/020,884, filed on Jan. 14, 2008.

(51) Int. Cl.

| | |
|---|---|
| ***A61G 1/013*** | (2006.01) |
| ***A61G 1/02*** | (2006.01) |
| ***A61G 1/056*** | (2006.01) |
| *A61G 7/05* | (2006.01) |

(52) U.S. Cl.

CPC ..... *A61G 1/0262* (2013.01); *A61G 1/0567* (2013.01); *A61G 1/0237* (2013.01); *A61G 1/0212* (2013.01); *A61G 2007/0509* (2013.01); *A61G 2203/723* (2013.01)

USPC ..... 5/627; 5/11; 5/611; 5/86.1; 296/20

(58) Field of Classification Search

USPC ..... 5/611, 620, 625, 627, 110, 111, 86.1, 5/11; 296/20

See application file for complete search history.

(56) References Cited

U.S. PATENT DOCUMENTS

| | | | | |
|---|---|---|---|---|
| 4,097,941 | A | 7/1978 | Merkel | |
| 4,767,148 | A | 8/1988 | Ferneau et al. | |
| 5,509,159 | A * | 4/1996 | Du-Bois | 5/627 |
| 5,537,700 | A * | 7/1996 | Way et al. | 5/611 |
| 5,575,026 | A | 11/1996 | Way et al. | |
| 6,389,623 | B1 | 5/2002 | Flynn et al. | |
| 6,526,611 | B2 | 3/2003 | Flynn et al. | |
| 6,701,545 | B1 * | 3/2004 | Ferneau et al. | 5/86.1 |
| 7,100,224 | B2 | 9/2006 | Knipfel | |
| 7,389,552 | B1 * | 6/2008 | Reed et al. | 5/86.1 |
| 2005/0241063 | A1 | 11/2005 | Ferneau et al. | |
| 2006/0075558 | A1 | 4/2006 | Lambarth et al. | |
| 2007/0056115 | A1 | 3/2007 | Flick | |

FOREIGN PATENT DOCUMENTS

| | | |
|---|---|---|
| WO | WO 2007/069066 | 6/2007 |

* cited by examiner

*Primary Examiner* — Nicholas Polito

(74) *Attorney, Agent, or Firm* — Warner Norcross & Judd LLP

(57) ABSTRACT

A stretcher includes a patient support, a base, a plurality of support members supporting the patient support relative to the base, which are adapted and arranged to raise or lower the base relative to the patient support, and a locking mechanism. The locking mechanism is actuatable between a locked position wherein the locking mechanism locks the support members at a fixed height and an unlocked position wherein the support members are released from being locked at the fixed height so that the base or the patient support may be moved relative to the other. Further, the locking mechanism is configured to provide a stop for the support members and absorb energy from the support members are release and the support members engage the stop.

21 Claims, 9 Drawing Sheets

EMERGENCY STRETCHER

CROSS-REFERENCE TO RELATED APPLICATION

This application claims priority from U.S. Pat. Application Ser. 61/020,884, filed Jan. 14, 2008, entitled EMERGENCY STRETCHER, which is incorporated by reference herein in its entirety.

TECHNICAL FIELD AND BACKGROUND OF THE INVENTION

The present invention relates to an emergency stretcher or cot and, more particularly, to an emergency stretcher that exhibits improved dampening and, further, provides increased base stiffness to reduce side-to-side tilting.

When a stretcher is unloaded, for example from an ambulance, it is often desirable to allow the base of the stretcher to be quickly released and lowered from its compact configuration in the ambulance to a ground engaging position spaced further from the patient support or litter of the stretcher. This release is referred to as a "hot-drop" function, which allows a single emergency medical technician (EMT) to remove a stretcher out of the back of an ambulance without the need for a second EMT or helper to hold or assist the base being moved down to the ground. However, this release can generate significant impact loads on various components of the stretcher. Further, over time, these impact loads may cause damage to various components.

Accordingly, there is a need to provide a dampening system to at least reduce the impact to the various components of a stretcher while still providing the hot-drop capability without hindering the functionality of the stretcher.

SUMMARY OF THE INVENTION

Accordingly, the emergency stretcher of the present invention provides a dampening system that at least reduces the impact loads on some of the components of the emergency stretcher. Further, the stretcher of the present invention includes a support frame with the handling capability of prior support frames but with increased stiffness via additional frame structure to reduce the side-to-side tilting of the litter surface that may occur on prior ambulance stretchers.

In one form of the invention, a stretcher includes a patient support, a base, a plurality of support members supporting the patient support relative to the base, which are adapted and arranged to raise or lower the base relative to the patient support, and a locking mechanism. The locking mechanism is actuatable between a locked position, wherein the locking mechanism locks the support members at a fixed height, and an unlocked position wherein the support members are released from being locked at their fixed height so that the base or patient support can be moved relative to the other. Further, the locking mechanism is configured to provide a stop so that when the locking mechanism is in its unlocked position and the support members are released, the locking mechanism absorbs energy from the support members when the support members engage the stop.

In one aspect, the locking mechanism defines a plurality of locked positions. For example, the locking mechanism may include a plurality of notches which define the plurality of locked positions.

In another aspect, the locking mechanism comprises a pair of elongate members pivotally mounted at one end to the patient support and movable at their opposed ends between a first position wherein the elongate members lock the position of the support members and a second position wherein the support members are released from their locked position. Further, the locking mechanism optionally includes one or more bumpers to thereby form the stop. Where at least two bumpers are provided, each of the bumpers may be mounted to a respective elongate member.

In a further aspect, each of the elongate members has a high slenderness ratio and thus exhibits spring force properties to thereby further absorb energy when the locking mechanism is in its unlocked position and the support members engage the stop. For example, each of the elongate members may comprise an elongate rectangular bar.

In yet other aspects, one or more of the support members comprises an adjustable length support member, with a first pair of the support members being connected together at a generally medial portion thereof by a pivot connection, and a second pair of the support members being connected together at a generally medial portion thereof by another pivot connection. Each of the pairs of the support members has a stationary pivot connection at the patient support and a movable pivot connection at the patient support. The movable pivot connections are joined by a transverse member, which is engaged by the elongate members of the locking mechanism when the elongate members are moved to their first positions wherein the elongate members lock the longitudinal position of the transverse member and thereby lock the vertical height of the support members. When the elongate members of the locking mechanism are moved to their second positions, the transverse member is released for longitudinal movement relative to the elongate members so that the height of the stretcher may be adjusted.

In other aspects, one or more of the support members comprises a telescoping member. For example, a first group of support members may form a first X-frame, and a second group of the support members may form a second X-frame spaced from the first X-frame, with at least one member of each X-frame comprising a telescoping member. Each of the support members of the first X-frame are pivotally mounted at a medial portion thereof about a generally horizontal pivot axis, and each of the support members of the second X-frame are pivotally mounted at a medial portion thereof about the same generally horizontal pivot axis.

In another form of the invention, a stretcher includes a patient support, a base, and a plurality of support members, which support the patient support relative to the base. Each of the support members comprises a variable length support member and is adapted and arranged to raise or lower the base relative to the patient support or the patient support relative to the base.

One of the support members comprises an H-shaped support member having a U-shaped frame with a transverse frame member and a pair of telescoping members extending into the U-shaped frame at the transverse frame member to thereby form the H-shaped support member. The other support member comprises telescoping members pivotally coupled to the U-shaped frame member at a medial portion of the telescoping members.

In one aspect, the stretcher further includes a locking mechanism, which is actuatable between a locked position, wherein the locking mechanism locks the support members at fixed lengths, and an unlocked position wherein the support members are free to extend or contract to lower or raise the base or the patient support relative to the other.

In a further aspect, the stretcher further includes a shock absorber, which absorbs energy when the support members engage the shock absorber, such as when the support members are released to allow the base or the patient support to be moved to a preset position. For example, the locking mechanism may include the shock absorber. Further, the shock absorber may comprise one or more stops, such as one or more bumpers, including plastic bumpers.

According to yet another form of the invention, a stretcher includes a patient support, a base, a plurality of support members, which support the patient support relative to the base and are adapted and arranged to raise or lower the base relative to the patient support, and a locking mechanism. The locking mechanism is actuatable between a locked position wherein the locking mechanism locks the support members at a fixed height and an unlocked position wherein the support members are released to raise or lower the base relative to the patient support. In addition, the locking mechanism forms a spring due to its high slenderness ratio to absorb energy when the locking mechanism is in its unlocked position and the support members are released to lower the base relative to the patient support to a lowered position or are releases to raise the base relative to the patient support to a raised position.

In one aspect, the locking mechanism comprises a pair of elongate members pivotally mounted at one end to the patient support and movable at their opposed ends between a first position wherein the elongate members lock the position of the support members and a second position wherein the support members are released from their locked positions.

In one aspect, the support members comprise telescoping members. In a further aspect, the locking mechanism further comprises a pair of bumpers to further absorb energy when the locking mechanism is in its unlocked position and the telescoping members are released and the base or the patient support is moved to its lowered or raised position.

In addition, the locking mechanism may define the lowered and/or raised positions. Further, the raised position and/or the lowered position may be adjustable to thereby vary the load height of the stretcher.

In yet a further aspect, the locking mechanism includes at least one bumper to define the raised position or the lowered position. For example, the bumper may be adjustable to adjust the position of the raised position or the lowered position.

According to yet another form of the invention, a method for adjusting the height of a stretcher, which includes a patient support, a base, a plurality of support members supporting the patient support relative to the base, and a locking mechanism for fixing the vertical height of the support members, includes moving the locking mechanism to its unlocked position to thereby release the support members to move either the base or the patient support, and stopping the movement of the base or patient support at a preset position with the locking mechanism when the locking mechanism is still in its unlocked position to thereby absorb at least some of the impact load with the locking mechanism when the base or support reaches the preset position.

In one aspect, the movement of the base or the patient support is mechanically stopped.

In another aspect, the preset position comprises a first preset position associated with a first load height of the stretcher, and the method further includes adjusting the load height of the stretcher by providing at least a second preset position spaced from the first preset position, which provides a second load height. For example, the base or patient support may be stopped by a stop at the first preset position, and the height is adjusted by moving the stop from the first preset position to the second preset position. In a further aspect, the base or patient support is stopped by a mechanical stop. In addition, the stop may be mechanically moved from the first preset position to the at least second preset position to adjust the location of the stop.

Accordingly, the present invention provides a stretcher with improved dampening, a support frame with increased stiffness, and/or an adjustable load height.

These and other objects, advantages, purposes and features of the invention will become more apparent from the study of the following description taken in conjunction with the drawings.

DETAILED DESCRIPTION OF THE INVENTION

Figure 1:
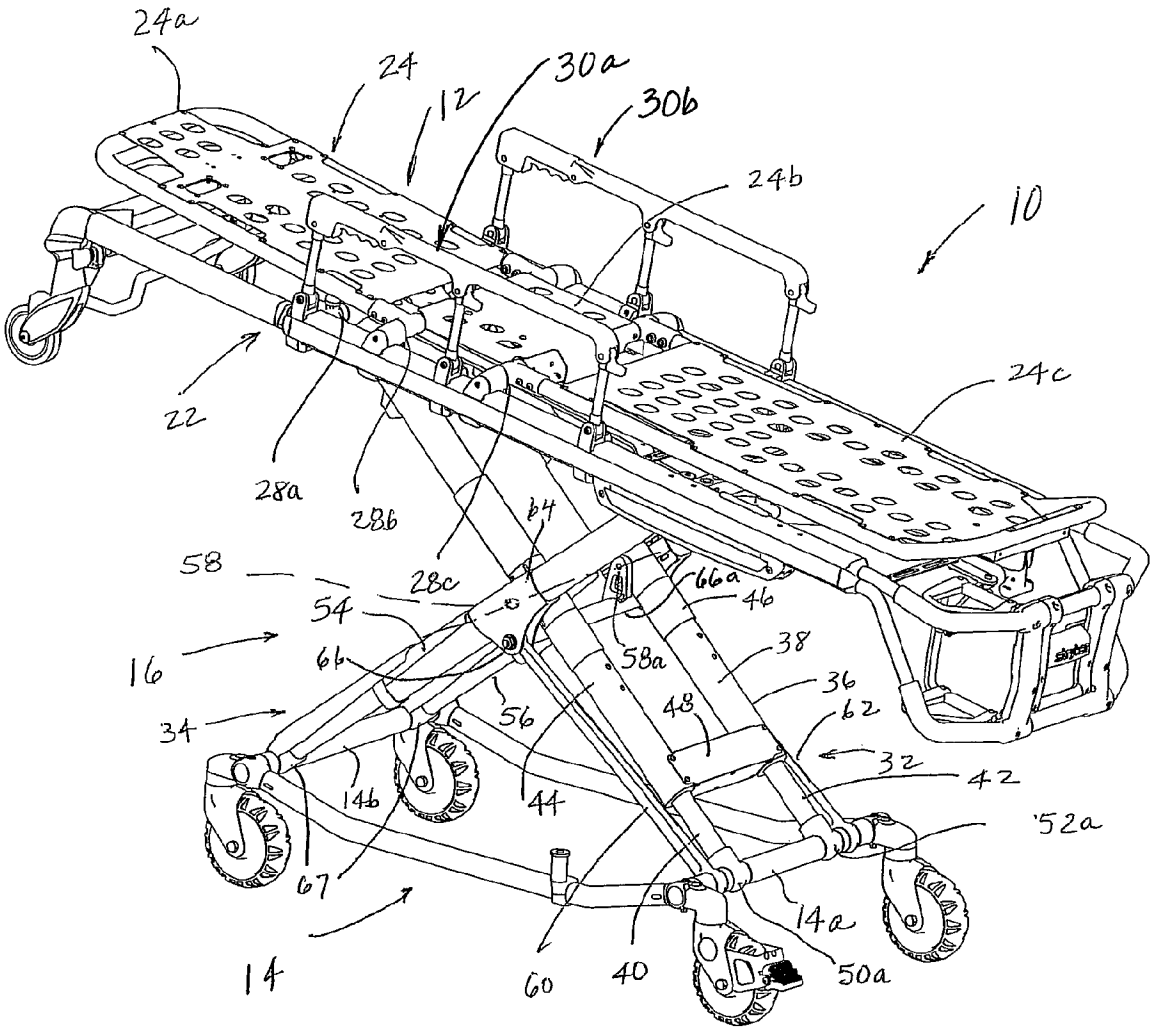
FIG. 1. is a perspective view of the emergency stretcher of the present invention.

Referring to FIG. 1, the numeral 10 generally designates an emergency stretcher or cot of the present invention. Emergency stretcher 10 includes a patient support 12 and a base 14, with a plurality of bearings, such as wheels or castors. Patient support 12 is supported on base 14 by a support frame 16, which is configured to raise and lower the base or patient support relative to the other of the base and patient support so that the stretcher can be rearranged between a more compact configuration for loading into an emergency vehicle, such as an ambulance, and a configuration for use in transporting a patient across a ground surface, as will be more fully described below.

To lock the vertical height of support frame 16, stretcher 10 incorporates a locking mechanism 18 (FIG. 2), which also provides a height adjustment function that allows the vertical height of the patient support 12 relative to base 14 to be varied. In addition, locking mechanism 18 is configured to provide a dampening function so that when support frame 16 is no longer locked in its vertical fixed height configuration by locking mechanism 18, locking mechanism 18 will absorb at least some of the impact that results from the support frame 16 being released from its locked configuration. For example, when the stretcher is pulled out from the back of an ambulance, it is often desirable to let the support frame drop so that the base quickly moves from its compact configuration just beneath the patient support to its ground engaging position so that a single EMT can handle the stretcher. Similarly, an EMT may wish to quickly raise the base, which also generates an impact force on the stretcher. Further, as will be more fully described below in reference to FIG. 11, the locking mechanism may also be configured to provide a load height adjustment function.

Figure 2:
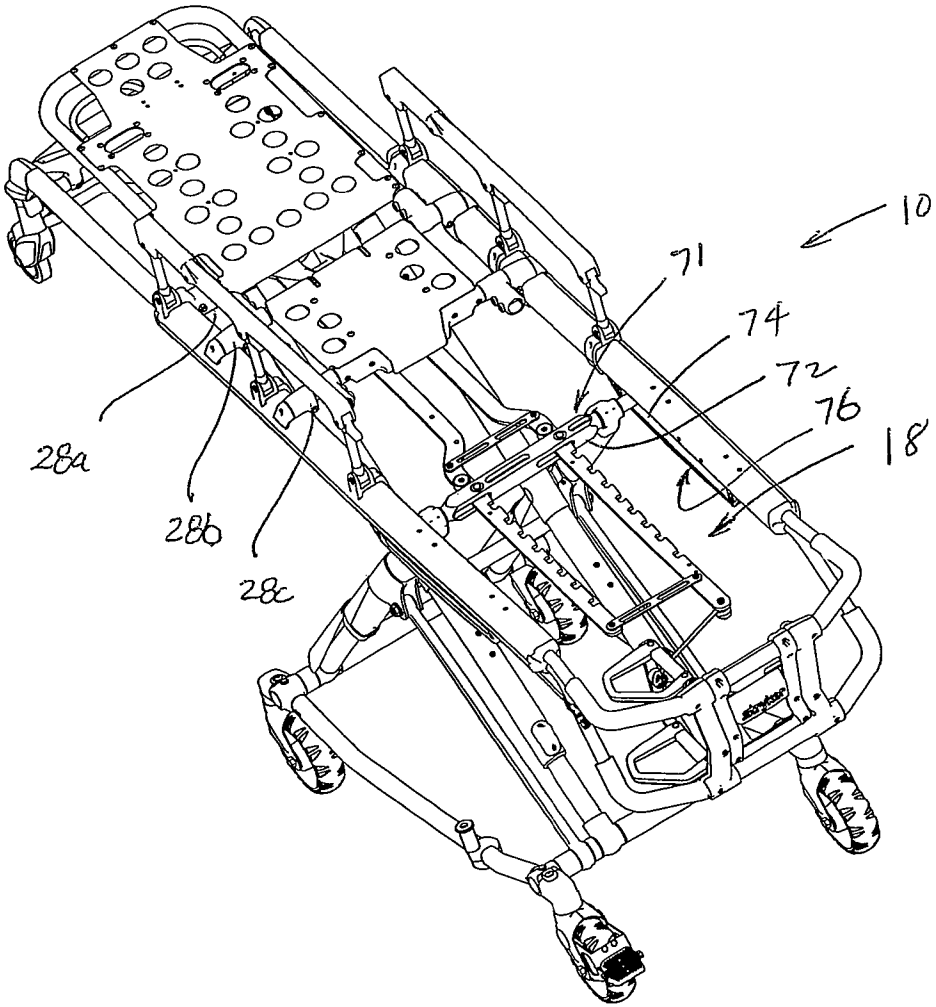
FIG. 2. is another perspective view of the emergency stretcher of FIG. 1 with the litter deck partially removed for clarity.

As best seen in FIGS. 1 and 2, patient support 12, which is commonly referred to as a litter, includes a frame or litter frame 22 and a deck or litter deck 24, which optionally includes a backrest section 24*a*, a seat section 24*b*, and a foot section 24*c*, with sections 24*a* and 24*c* being pivotally mounted to frame 22. Referring again to FIGS. 1 and 2, frame 22 includes a pair of side frame members 26*a* and 26*b*, which are interconnected by cross- or transverse frame members 28*a*, 28*b*, and 28*c*, with cross-frame member 28*a* providing a mounting point for support frame 16, more fully described below. Cross-frame members 28*b* and 28*c* provide support for seat section 24*b* of deck 24, with backrest section 24*a* pivotally mounted about cross-frame member 28*b*, and foot deck section 26*c* pivotally mounted about cross-frame member 28*c*. Further, cross-frame member 28*a* provides a mounting point for locking mechanism 18, also described more fully below. In addition, side frame members 26*a* and 26*b* provide support for collapsible side rails 30*a* and 30*b*. For further details of patient support 12, reference is made to U.S. Pat. No. 5,537,700 and copending published Application No. 2006/0075558, published Apr. 13, 2006, commonly owned by Stryker Corporation, which are herein incorporated by reference in their entireties.

Referring again to FIG. 1, support frame 16 includes a plurality of support members 32 and 34, which are configured to support patient support 12 on base 14 and, further, to provide height adjustment of patient support 12 relative to base 14. Support member 32 comprises an H-shaped frame 36 with a U-shaped frame member 38 and a pair of telescoping frame members 40 and 42, which extend into U-shaped frame member 32 to provide an adjustable length support member. U-shaped member 32 includes a pair of generally parallel frame members 44 and 46, which are interconnected by a transverse or cross-brace member 48. Members 44 and 46 comprise tubular members into which frame members 40 and 42 extend. The distal ends of frame members 40 and 42 are pivotally mounted to base frame member 14*a* of base 14 by a pair of pivot connectors 50*a* and 52*a*, while the upper ends of support member 32 are pivotally mounted to cross-frame member 28*a* by a pair of pivot connectors 50*b* and 52*b*.

Support member 34 may also be adjustable in length and may be formed by a pair of telescoping members 54 and 56, which are pivotally connected to support member 32 at a general medial portion of U-frame member 38 at a pivot axes 58 (FIG. 4) by pivot pins 58*a*. In this manner, support members 32 and 34 form a pair of X-frames, which are interconnected at a point below pivot axis 58 by cross-brace or transverse member 48. As would be understood, in this manner, cross-brace 48 ties the extension and contraction of the respective telescoping frame members 40 and 42 together such that the distances between the respective pivot connectors 50*a*, 50*b* and 52*a*, 52*b* are substantially equal and not independent of each other and, instead, are tied together to thereby increase the stiffness of support frame 16 and, further, of the overall stretcher 10. However, it should be understood that members 54 and 56 may comprise fixed length members, for example such of the type shown in U.S. Pat. No. 6,701,545, which is incorporated herein by reference in its entirety. Consequently, stretcher 10 has an increased base stiffness that reduces side-to-side tilting, which is particularly advantageous when transporting heavier patients.

In addition to support members 32 and 34, support frame 16 includes a pair of linkage members 60 and 62, which are pivotally mounted on one end to transverse member 14*a* of base 14 and on their other ends to the upper end of members 54 and 56. In the illustrated embodiment, linkage members 60 and 62 are pivotally mounted to the upper end of telescoping members 54 and 56 by brackets 64 and a pivot pin or bolt 66, which extends through the brackets and through a tubular member 66*a*, to thereby pivotally mount linkage members 60 and 62 to their respective brackets offset from the pivot axis 58 of the respective support members 32 and 34.

Similar to support member 32, telescoping members 54 and 56 are pivotally mounted on one end to transverse base frame member 14*b* by pivot connectors 67 and, further, mounted to patient support 12 by a common movable pivot connection 71. As best seen in FIG. 2, pivot connection 71 includes a translating transverse member 72, with the upper ends of telescoping members 54 and 56 mounted to transverse member 72 by pivot connectors 73. Opposed ends of translating transverse member 72 are supported in slotted openings 74 of bracket housings 76, which are mounted to and beneath side frame members 26*a* and 26*b*. For further details of how translating transverse member 72 is mounted in bracket housings 76, reference again is made to published copending application Publication No. US 2006/0075558. In this manner, pivot connection 71 allows telescoping members 54 and 56 to pivot about a moving horizontal axis and, further, allow support frame 16 to adjust the height of patient support 12 relative to base 14 and, further, to assume a compact configuration so that stretcher 10 may be loaded into an ambulance, for example.

Figure 3:
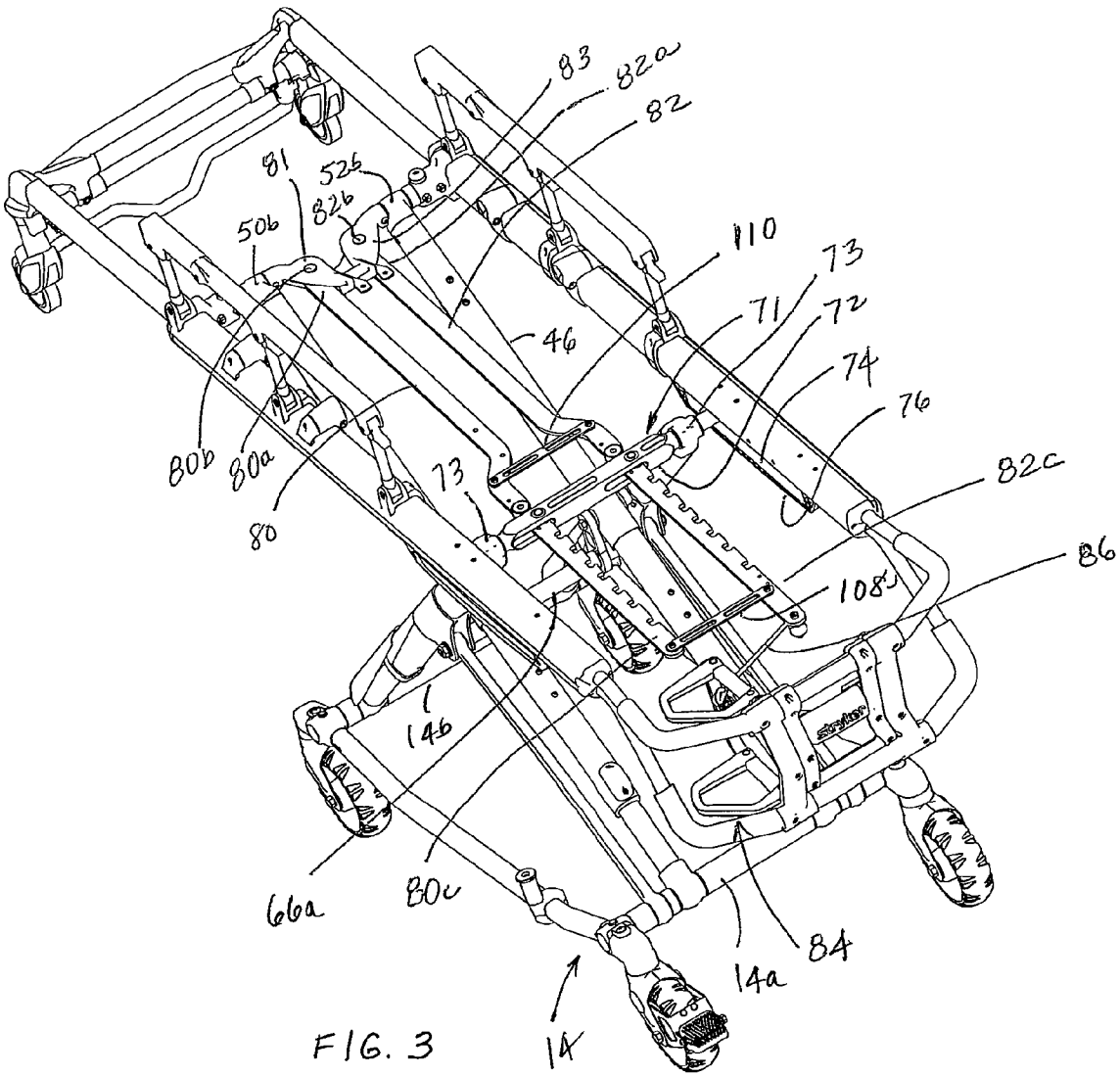
FIG. 3 is a perspective view of the emergency stretcher with the litter deck fully removed to show a locking mechanism.

As noted above, in order to lock the respective lengths of the support members 32 and 34, stretcher 10 incorporates locking mechanism 18. Referring again to FIG. 3, locking mechanism 18 includes a pair of elongate members 80 and 82, which are pivotally mounted at their proximal ends 80*a* and 82*a* about generally vertical axes 80*b* and 82*b* to cross-frame member 28*a* by a pair of brackets 81 and 83. Distal end portions 80*c* and 82*c* of elongate members 80 and 82 are coupled to a handle assembly 84 by a linkage member 86, which moves the elongate members 80 and 82 between a locked position (such as show in FIGS. 5 *and* 6) and an unlocked position.

Figure 5:
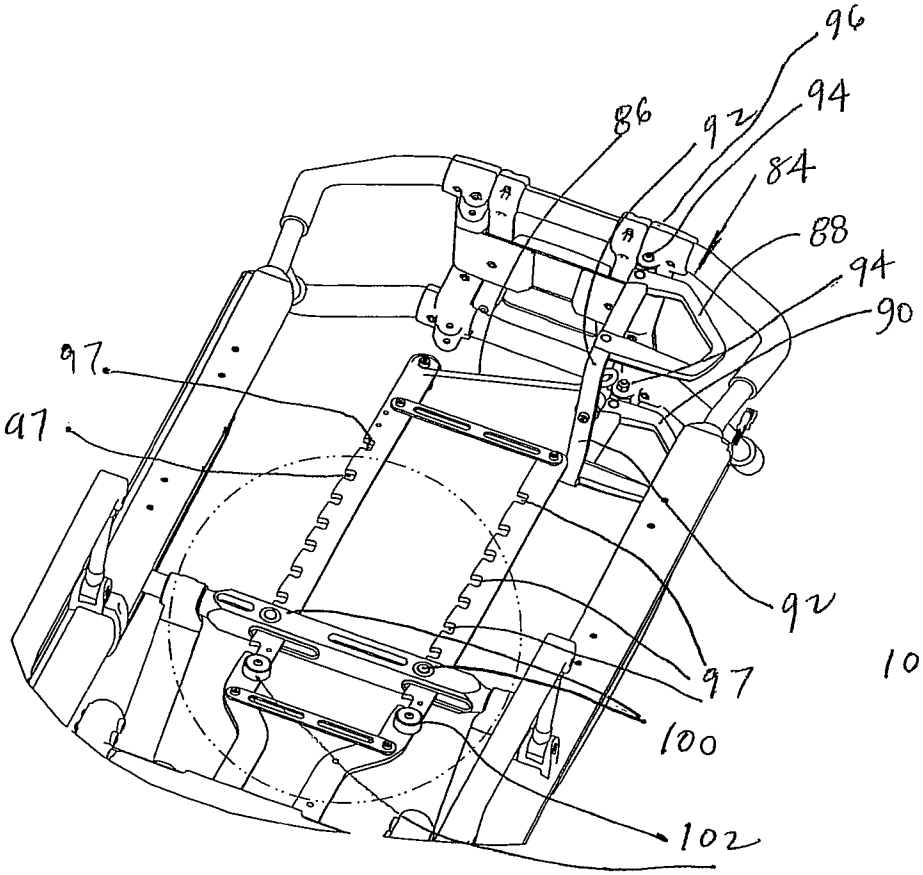
FIG. 5. is an enlarged view of the foot end of the emergency stretcher of FIG. 2 illustrating a locking mechanism that may also provide a height adjustment function.

Handle assembly 84 includes two handles 88 and 90, which are commonly mounted on a C-shaped frame member 92, which is pivotally mounted to litter frame 22 by pivot bolts 94. Bolts 94 are mounted to brackets 96, which are connected to litter frame 22. Optionally, handles 88 and 90 may be spring biased, for example by springs located at or near brackets 96, inwardly toward an engaged or locked position, such as shown in FIG. 5, wherein elongate members 80 and 82 are engaged with a respective pair of posts 100 described more fully below. Again, for further details of brackets 96 and litter frame 22, reference is made to the above-referenced patent and published application. In this manner, when either handle 88 or 90 is pulled to the right, for example against the biasing force of the spring, handle assembly 84 will pivot about bolts 94 and linkage member 86 will pull on locking mechanism 18 so that locking mechanism 18 will similarly shift to the right to thereby disengage from posts 100.

Figure 10:
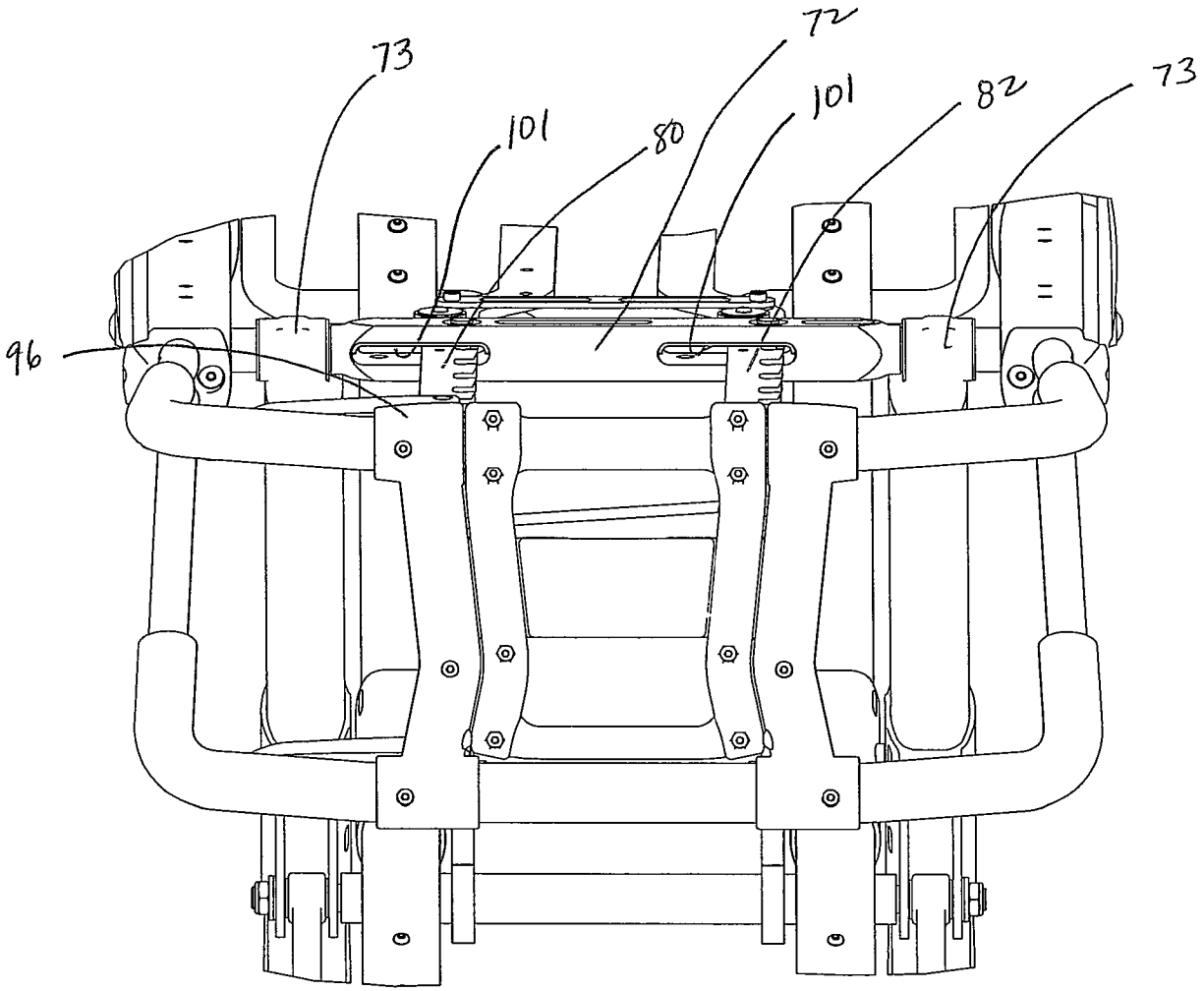
FIG. 10. is an end view of the locking mechanism illustrating the stops engaged by the support frame in its fully extended or maximum vertical height position.

Referring again to FIGS. 5 and 6, each elongate member 80, 82 includes a plurality of notches 97 for engaging translating transverse member 72. As best understood from FIG. 6, transverse member 72 includes a plurality of transverse passages 98 through which elongate members 80 and 82 extend. Located in passageways 98 are posts or pins 100, which extend through transverse member 72 to provide engagement surfaces for engagement by notches 97 of elongate members 80 and 82. Thus when posts 100 are located and fully seated in a pair of notches 97, the longitudinal position of translating transverse member 72 is locked relative to the longitudinal axis of stretcher 10. By providing a plurality of longitudinally spaced notches, therefore, locking mechanism 18 provides a height adjustment function as well as a locking function. Thus when either handle 88, 90 is moved to the right as viewed in FIG. 3, elongate members 80 and 82 are disengaged from posts 100 and moved to an unlocked position to thereby allow translating transverse member 72 to translate along slotted openings 74 of bracket housings 76. Further, to facilitate the movement of translating transverse member 72 along elongate members 80 and 82, passageways 98 optionally incorporate bearings 101 (FIG. 10).

When support frame 16 has reached a desired height, handles 88 or 90, which as noted may be spring biased inwardly toward the stretcher, may then be released or pushed inwardly so that elongate members 80 and 82 pivot about their respective proximal ends 80*a* and 82*a* to engage posts 100 with another set of notches 97 to thereby fix the height of the stretcher. As will be understood, when translating transverse member 72 is fixed in position longitudinally with respect to the stretcher, the height of stretcher 10 is fixed. Therefore, when the stretcher is removed from an emergency vehicle and the hot-drop function is desired, the user may simply pull on one of the handles 88, 90 to release the locking mechanism from engagement with posts 100 and allow translating transverse member 72 to translate along slotted openings 74.

Figure 8:
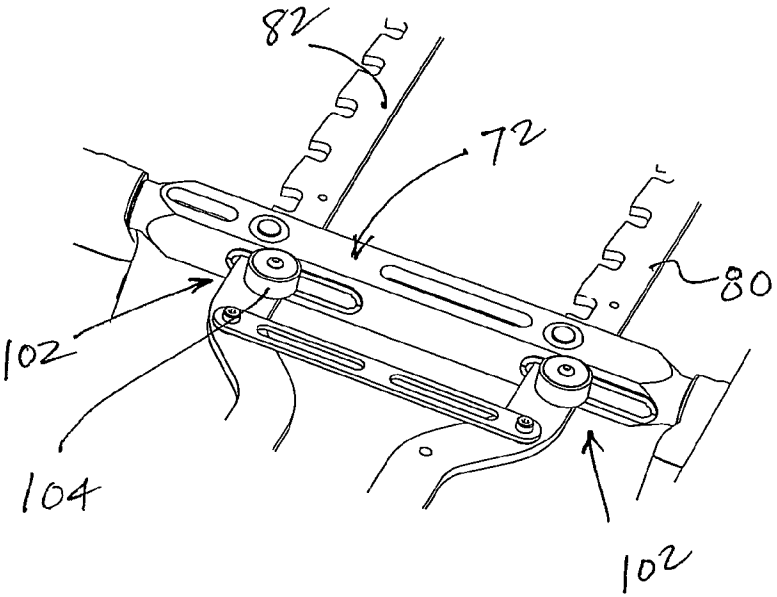
FIG. 8 is a similar view to FIG. 6 illustrating the stops engaged by the support frame in its fully extended position.
Figure 7:
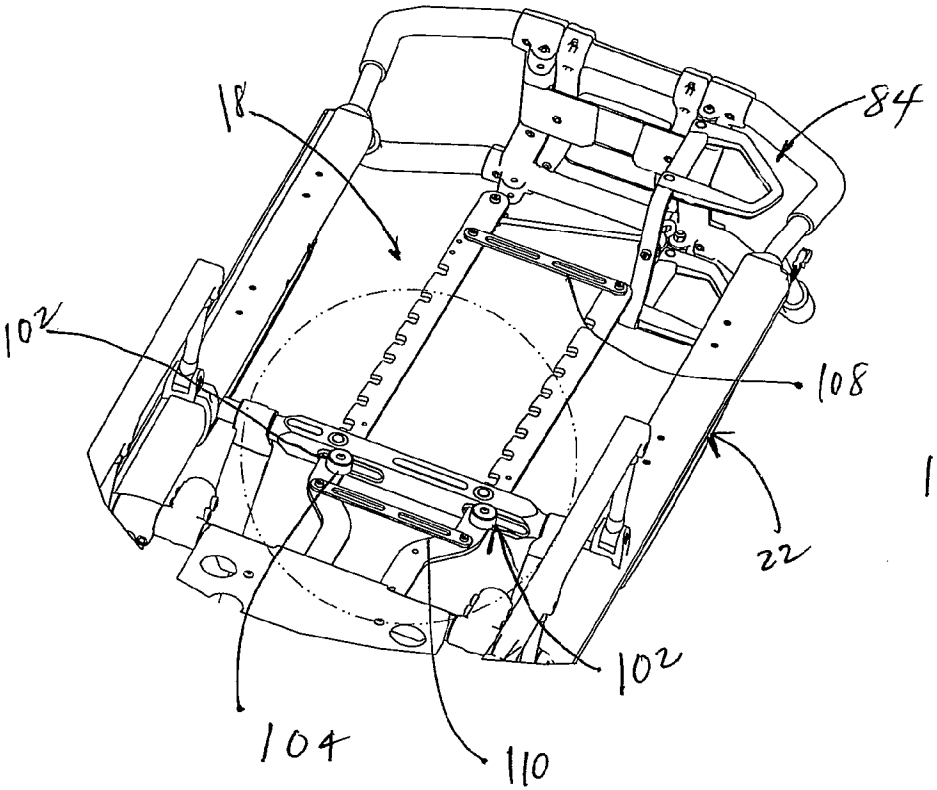
FIG. 7. is an enlarged plan view of a portion of the locking mechanism illustrating the stops of the locking mechanism in a first position.

To reduce the impact on the various components on stretcher 10, as noted above, locking mechanism 18 is adapted to absorb at least some of the impact energy when support frame 16 is released from engagement with the locking mechanism and drops base 14 to the ground, for example. In addition, locking mechanism 18 may be adapted to absorb energy when the support frame is lifted up to its compact configuration, which may also induce impact loads on the stretcher structure. Referring to FIGS. 7 and 8, when base 14 is allowed to drop and support frame 16 allowed to extend to its fully extended position, translating transverse member 72 will move downward as viewed in FIG. 7 and will engage stops 102. In the illustrated embodiment, stops 102 are mounted on locking mechanism 18. Stops 102, therefore, transfer at least some of the impact forces to elongate members 80 and 82. Because of their length and slender construction (high slenderness ratio), members 80 and 82 will deflect under the impact load and in effect act like a pair of springs to thereby absorb at least some of the energy when the locking mechanism is in its unlocked position and the support members engage the stops. Furthermore, stops 102 optionally comprise bumpers 104 formed from an energy absorbing material, such as a plastic material, including an engineered plastic, such as isobutyl rubber, which will also absorb some of the impact load due to the hot-drop function of the structure.

Figure 9:
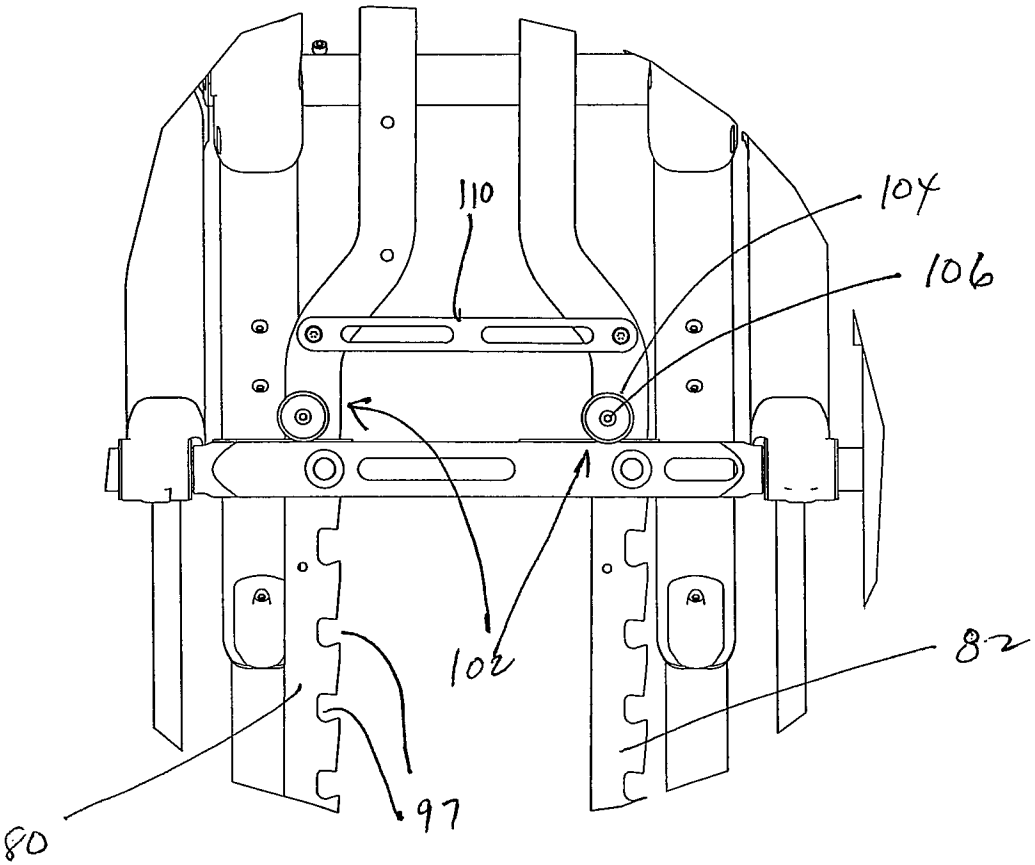
FIG. 9. is an enlarged plan view of a portion of the locking mechanism of FIG. 8.
Figure 11:
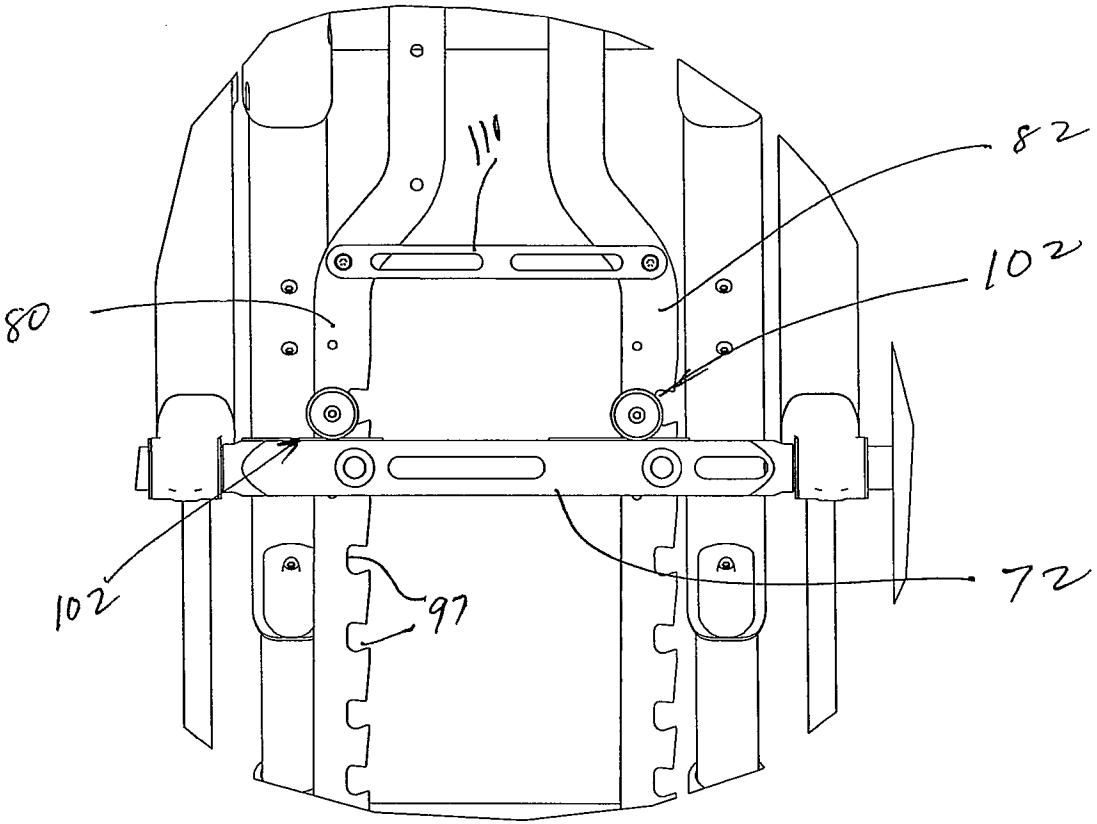
FIG. 11. is a similar view to FIG. 9 illustrating the stops moved to a second position to adjust the height of the load emergency stretcher.

As best seen in FIGS. 8 and 9, bumpers 104 are mounted to the respective elongate members 80 and 82 by pins 106, which extend through mounting openings provided in members 80 an 82. Pins 106 may be secured in place by nuts or other fasteners to allow the pins to be manually removed so that the bumpers can be removed. Further, as best seen in FIG. 11, elongate members 80 and 82 may include a plurality of mounting openings to allow the bumpers to be moved and relocated at a different stop position along the length of the elongate members to adjust the maximum height of the stretcher to accommodate variation in the load height for ambulance load decks. For example, when an emergency department purchases an emergency stretcher, the stretcher may have a longer life expectancy than the emergency vehicle. Therefore, even if the stretcher is initially purchased with a load height that is suited to their present needs, the manually removable and adjustable bumpers would allow the emergency department to move the bumpers to accommodate newer or different vehicles with various load heights. For example, the load height currently can vary from about 28 inches to about 36 inches between vehicles. Additionally, mass casualty situations may require ambulance cots to be used in different vehicles to properly manage the situation (i.e. cot A normally associated with vehicle A goes into vehicle B, and cot B normally associated with vehicle B goes into vehicle C).

Figure 4:
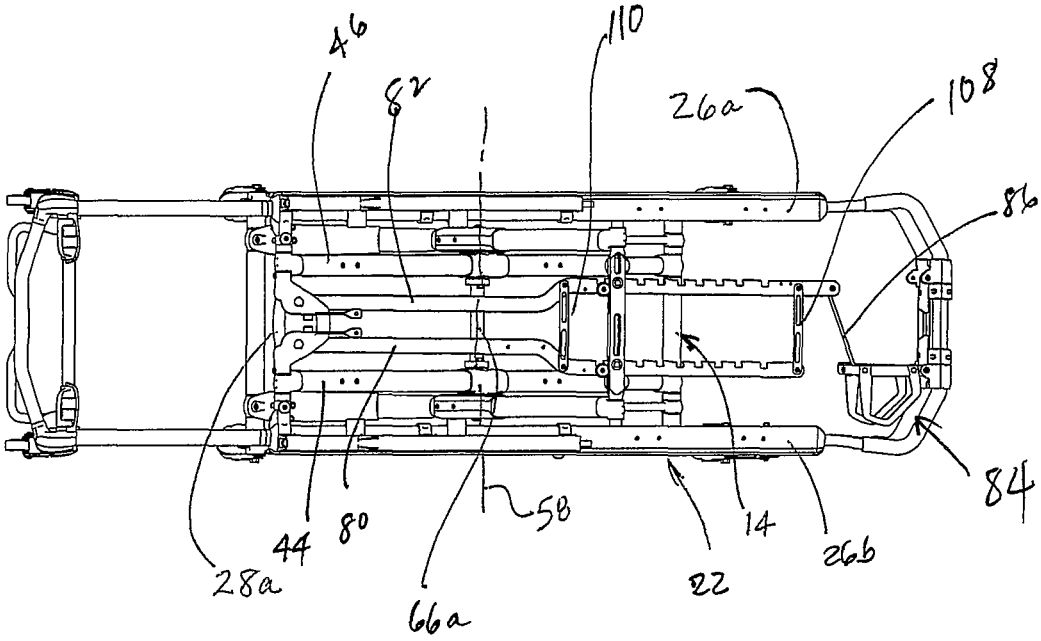
FIG. 4 is a top plan view of the emergency stretcher with the litter deck removed.
Figure 6:
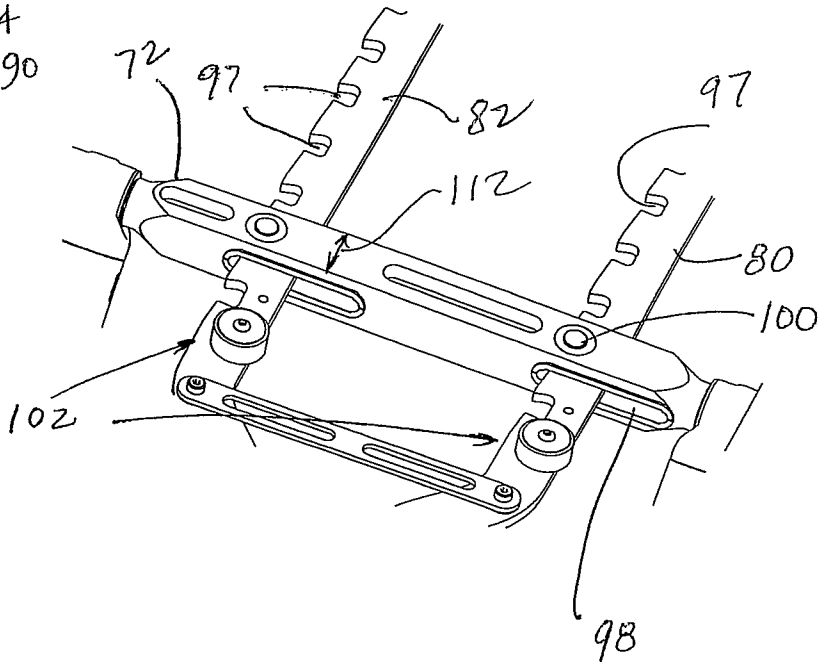
FIG. 6. is an enlarged view of the mounting arrangements of the locking mechanism of FIG. 5.

Referring again to FIGS. 3 and 5, in order to maintain elongate members 80 and 82 generally parallel and further to move both elongate members in unison, elongate members 80 and 82 are interconnected by a pair of transverse brace members 108 and 110, which maintain elongate members 80 and 82 in a generally parallel and rectangular arrangement, as best understood from FIGS. 3-6. Referring again to FIG. 6, transverse passageways 98 each have a transverse extent 112, which results in sufficient bearing contact with elongate members 80 and 82 to provide limited torsional resistance to member 72, which may further improve the stiffness of stretcher 10.

Accordingly, the present invention provides a stretcher with a dampening system that reduces the impact on some components of the stretcher associated with a hot-drop function. Furthermore, the support frame of the present invention provides an increased stiffness, which provides enhanced lateral stability to the patient support, which may improve the patient's sense of security, especially for bariatric patients. Further, the present invention provides a stretcher with an adjustable load height.

While several forms of the invention have been shown and described, other forms will now be apparent to those skilled in the art. For example, while illustrated as mechanical stops, the stops may comprise non-contact stops or bumpers, such as a magnetic field that is generated, for example by an electromagnet and when actuated creates a magnetic coupling that stops the movement, for example of the translating traverse member 72. Further, the stops may be provided on the translating member 72, which stops then make contact with, for example, the elongate members of the locking mechanism. In addition, one or more of the features of the stretcher of the present invention may be incorporated into other stretchers. Similarly, other features form other stretchers may be incorporated into the stretcher of the present invention. Examples of other stretchers that may incorporate one or more of the features described herein or which have features that may be incorporated herein are described in U.S. Pat. Nos. 7,100,224; 5,537,700; 6,701,545; 6,526,611; 6,389,623; and 4,767,148, and U.S. Publication Nos. 2005/0241063 and 2006/0075558, which are all incorporated by reference herein in their entireties. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A stretcher comprising:

a patient support;

a base;

a plurality of support members supporting said patient support relative to said base, said support members forming sliding pivot connections with said patient support and being adapted and arranged to raise or lower said base relative to said patient support; and a locking mechanism actuatable between a locked position wherein said locking mechanism locks said support members at a fixed height and an unlocked position wherein said support members are released from being locked at said fixed height to move one of said base and said patient support relative to the other of said base and said patient support, and when said locking mechanism is in its unlocked position said locking mechanism is configured to provide a stop for said support members inboard of said sliding pivot connections and, further, configured to form a spring to absorb energy from said support members when said support members engage said stop.

2. The stretcher according to claim 1, wherein said locking mechanism defines a plurality of locked positions.

3. The stretcher according to claim 2, wherein said locking mechanism includes a plurality of notches defining said plurality of locked positions.

4. The stretcher according to claim 1, wherein said sliding pivot connections include a transverse member slidably supported in opposed channels each with opposed closed ends, said locking mechanism comprising a pair of elongate members pivotally mounted at one end to said patient support and movable at their opposed ends between a first position wherein said elongate members engage said transverse member to lock the position of the support members and a second position wherein said elongated members release engagement of said transverse member wherein the support members are released from said locked position, and wherein said stop is located between said opposed closed ends of said opposed channels to thereby form a stop inward of said opposed closed ends such that said elongated members absorb the impact when said transverse member engages said stop when said support members are fully extended or fully retracted.

5. The stretcher according to claim 4, wherein said locking mechanism includes at least a pair of bumpers, and each of said bumpers being mounted to a respective elongate member and forming said stop.

6. The stretcher according to claim 4, each of said elongate members has a high slenderness ratio wherein said elongate members exhibit spring force properties to thereby further absorb energy when said locking mechanism is in its unlocked position and said support members engage said stop.

7. The stretcher according to claim 5, wherein each of said elongate members comprises an elongate rectangular bar.

8. The stretcher according to claim 4, wherein said support members comprise adjustable length support members, a first pair of said support members being connected together at a generally medial portion thereof by a pivot connection, a second pair of said support members being connected together at a generally medial portion thereof by another pivot connection, and each of said pairs of said support members having a stationary pivot connection at said patient support and a movable pivot connection at said patient support.

9. The stretcher according to claim 1, wherein said support members comprise telescoping members.

10. The stretcher according to claim 9, wherein a first group of said telescoping members form a first X-frame, and a second group of said telescoping members form a second X-frame spaced from said first X-frame, each of said telescoping members of said first X-frame being pivotally mounted at a medial portion thereof about a generally horizontal pivot axis, and each of said telescoping members of said second X-frame being pivotally mounted at a medial portion thereof about said generally horizontal pivot axis.

11. The stretcher according to claim 1, wherein each of said support members comprises a variable length support member, and wherein one of said support members comprises an H-shaped support member having a U-shaped frame with a transverse frame member and a pair of telescoping members extending into said U-shaped frame at said transverse frame member, and the other of said support members comprising telescoping members pivotally coupled to said U-shaped frame member at a medial portion of said telescoping members.

12. A stretcher comprising:

a patient support;

a base;

a plurality of support members supporting said patient support relative to said base, said support members being adapted and arranged to raise or lower said base relative to said patient support, and said support members including a cross-member extending transverse to said patient support, and said cross-member supporting locking members; and a locking mechanism actuatable between a locked position wherein said locking mechanism engages said locking members and thereby locks said support members at a fixed height and an unlocked position wherein said locking members are released from engagement with said locking mechanism and said support members are released to raise or lower said base relative to said patient support, and when said locking mechanism is disengaged from said locking members and in its unlocked position said locking mechanism forming a spring to absorb energy from said cross-member when said cross-member impacts said locking mechanism when said support members are released to lower said base relative to said patient support surface to a lowered position or to raise the patient support surface relative to the base to a raised position.

13. The stretcher according to claim 12, wherein said locking mechanism comprises a pair of elongate members pivotally mounted at one end to said patient support, said elongate members movable at their opposed ends between a first position wherein said elongate members engage said locking members and thereby lock the position of the support members and a second position wherein said locking members are released to lower or raise said base relative to said patient support surface.

14. The stretcher according to claim 12, wherein said locking mechanism comprises a pair of elongate rectangular bars, each of said bars forming said spring.

15. The stretcher according to claim 12, wherein said support members comprise telescoping members.

16. The stretcher according to claim 15, wherein said cross-member is guided in a pair of channels, said channels each having opposed ends, said locking mechanism further comprises a pair of bumpers located in between said opposed ends of said channels to absorb energy when said locking mechanism is in its unlocked position and said telescoping members are released to lower said base relative to said patient support.

17. The stretcher according to claim 12, wherein said locking member defines a plurality of locked positions.

18. The stretcher according to claim 12, wherein said locking member defines at least one of said raised position and said lowered position.

19. The stretcher according to claim 18, wherein at least one of said raised position and said lowered position is adjustable to thereby vary the load height of the stretcher.

20. The stretcher according to claim 19, wherein said locking mechanism includes at least one bumper to define said at least one of said raised position and said lowered position.

21. The stretcher according to claim 20, wherein said bumper is adjustable to adjust the position of said at least one of said raised position and said lowered position.

* * * * *